US012595723B2

(12) United States Patent
Madasu et al.

(10) Patent No.: US 12,595,723 B2
(45) **Date of Patent: *Apr. 7, 2026**

(54) MULTI-AGENT, MULTI-OBJECTIVE WELLBORE GAS-LIFT OPTIMIZATION

(71) Applicant: Landmark Graphics Corporation, Houston, TX (US)

(72) Inventors: Srinath Madasu, Houston, TX (US); Shashi Dande, Spring, TX (US); Keshava Prasad Rangarajan, Sugarland, TX (US)

(73) Assignee: Landmark Graphics Corporation, Houston, TX (US)

( * ) Notice: Subject to any disclaimer, the term of this patent is extended or adjusted under 35 U.S.C. 154(b) by 1044 days.

This patent is subject to a terminal disclaimer.

(21) Appl. No.: 17/613,761

(22) PCT Filed: Jul. 2, 2019

(86) PCT No.: PCT/US2019/040334

§ 371 (c)(1),
(2) Date: Nov. 23, 2021

(87) PCT Pub. No.: WO2021/002853

PCT Pub. Date: Jan. 7, 2021

(65) Prior Publication Data

US 2022/0228465 A1 Jul. 21, 2022

(51) Int. Cl.
*E21B 43/12* (2006.01)

(52) U.S. Cl.
CPC ..... *E21B 43/122* (2013.01); *E21B 2200/20* (2020.05)

(58) Field of Classification Search
CPC ..... E21B 43/122; E21B 2200/20
(Continued)

(56) References Cited

U.S. PATENT DOCUMENTS 4,267,885 A * 5/1981 Sanderford ..... E21B 47/07 417/54
6,182,756 B1 * 2/2001 Garcia ..... E21B 43/122 166/321

(Continued)

FOREIGN PATENT DOCUMENTS

WO 2013188087 12/2013
WO 2020032949 2/2020

OTHER PUBLICATIONS

Leonardo Vega (A Bayesian Production Analysis Technique for Multistage Hydraulically Fractured Wells, SPE 107356, 2017, pp. 1-10) (Year: 2017).*

(Continued)

*Primary Examiner* — Iftekhar A Khan
(74) *Attorney, Agent, or Firm* — Kilpatrick Townsend & Stockton, LLP

(57) ABSTRACT

A system and method for controlling a gas supply to provide gas lift for wellbore(s) using Bayesian optimization. A computing device controls a gas supply to inject gas into wellbore(s). The computing device receives first reservoir data associated with a first subterranean reservoir and simulates production using the first reservoir data, using a model for the first subterranean reservoir. The production simulation provides first production data. The computing device receives second reservoir data associated with a subterranean reservoir and simulates production using the second reservoir data, using a model for the second subterranean reservoir. The production simulation provides second production data. A Bayesian optimization of an objective function of the first and second production data subject to any gas injection constraints can be performed to produce gas-lift parameters. The gas-lift parameters can be applied to the gas supply to control injection of gas into the wellbore(s).

20 Claims, 11 Drawing Sheets

(58) Field of Classification Search
USPC ..... 703/10
See application file for complete search history.

(56) References Cited

U.S. PATENT DOCUMENTS

| | | | | |
|---|---|---|---|---|
| 7,565,933 | B2 * | 7/2009 | Kippie | C09K 8/58 166/309 |
| 7,577,527 | B2 * | 8/2009 | Vega Velasquez | E21B 43/26 702/6 |
| 7,627,461 | B2 * | 12/2009 | Guyaguler | G06Q 10/0631 700/32 |
| 7,953,584 | B2 * | 5/2011 | Rashid | E21B 43/122 166/336 |
| 8,113,288 | B2 * | 2/2012 | Bachtell | E21B 43/122 166/309 |
| 8,290,632 | B2 * | 10/2012 | Briers | E21B 43/12 700/285 |
| 8,571,688 | B2 * | 10/2013 | Coward | E21B 43/00 166/372 |
| 8,573,310 | B2 * | 11/2013 | Rouen | E21B 43/122 166/372 |
| 8,600,717 | B2 * | 12/2013 | Rashid | E21B 43/12 703/2 |
| 8,688,426 | B2 * | 4/2014 | Al-Shammari | E21B 43/16 703/5 |
| 9,031,674 | B2 * | 5/2015 | Rashid | E21B 43/00 700/32 |
| 9,157,308 | B2 * | 10/2015 | Balogun | E21B 43/121 |
| 9,280,517 | B2 * | 3/2016 | Liu | E21B 44/00 |
| 10,087,721 | B2 * | 10/2018 | Usadi | G06F 30/23 |
| 10,677,028 | B2 * | 6/2020 | Oliphant | E21B 43/122 |
| 11,946,348 | B2 * | 4/2024 | Reeves | E21B 43/122 |
| 2003/0047308 | A1 * | 3/2003 | Hirsch | E21B 47/06 166/250.15 |
| 2005/0267718 | A1 * | 12/2005 | Guyaguler | E21B 43/00 703/10 |
| 2007/0276542 | A1 * | 11/2007 | Coward | E21B 43/122 700/273 |
| 2008/0065363 | A1 * | 3/2008 | Middya | E21B 43/14 703/10 |
| 2008/0154564 | A1 * | 6/2008 | Rashid | E21B 43/122 703/10 |
| 2008/0202763 | A1 * | 8/2008 | Lafferty | E21B 43/123 166/372 |
| 2010/0082258 | A1 * | 4/2010 | Wang | E21B 47/103 702/12 |
| 2010/0307765 | A1 * | 12/2010 | Van Arkel | E21B 43/16 166/372 |
| 2011/0119037 | A1 * | 5/2011 | Rashid | E21B 43/12 703/2 |
| 2011/0168413 | A1 * | 7/2011 | Bachtell | E21B 43/122 166/105.5 |
| 2012/0046866 | A1 * | 2/2012 | Meyer | E21B 28/00 702/6 |
| 2012/0095603 | A1 * | 4/2012 | Rashid | E21B 43/00 700/282 |
| 2013/0188087 | A1 * | 7/2013 | Harada | H04N 1/3875 348/333.12 |
| 2014/0039793 | A1 * | 2/2014 | Querales | E21B 43/122 702/6 |
| 2015/0127314 | A1 * | 5/2015 | Fleming | G06F 30/20 703/10 |
| 2015/0134127 | A1 * | 5/2015 | Fleming | G05B 13/042 700/282 |
| 2015/0169798 | A1 * | 6/2015 | Fleming | E21B 41/00 703/2 |
| 2016/0053593 | A1 * | 2/2016 | Romer | F04F 1/08 700/282 |
| 2016/0053753 | A1 * | 2/2016 | Rashid | E21B 47/008 700/282 |
| 2016/0153268 | A1 * | 6/2016 | Vasques | E21B 43/128 166/372 |
| 2017/0091359 | A1 * | 3/2017 | Wong | E21B 43/14 |
| 2017/0107811 | A1 * | 4/2017 | Romer | E21B 43/123 |
| 2018/0096083 | A1 * | 4/2018 | Kang | E21B 41/00 |
| 2018/0163526 | A1 * | 6/2018 | Chidi | E21B 43/128 |
| 2018/0179869 | A1 * | 6/2018 | Moffett | E21B 41/00 |
| 2019/0211651 | A1 * | 7/2019 | Fleming | E21B 47/06 |
| 2020/0032949 | A1 * | 1/2020 | Schmitt | F16M 11/14 |
| 2020/0190964 | A1 * | 6/2020 | Romer | E21B 47/008 |
| 2020/0199977 | A1 * | 6/2020 | De Mattia | G05B 13/041 |
| 2020/0240259 | A1 * | 7/2020 | Balasubramaniam | E21B 47/06 |
| 2020/0270975 | A1 * | 8/2020 | Whiteman | E21B 43/122 |
| 2020/0284944 | A1 * | 9/2020 | Madasu | E21B 43/00 |
| 2020/0399999 | A1 * | 12/2020 | De Mattia | E21B 43/122 |
| 2021/0032965 | A1 * | 2/2021 | Bridges | E21B 43/16 |
| 2021/0047916 | A1 * | 2/2021 | Thiruvenkatanathan | E21B 47/135 |
| 2021/0140290 | A1 * | 5/2021 | Eslinger | E21B 43/128 |
| 2021/0222552 | A1 * | 7/2021 | Gao | G06Q 10/067 |
| 2021/0270111 | A1 * | 9/2021 | Reeves | E21B 43/122 |
| 2021/0404302 | A1 * | 12/2021 | Madasu | E21B 43/122 |
| 2022/0170353 | A1 * | 6/2022 | Chong | E21B 43/121 |
| 2022/0298898 | A1 * | 9/2022 | Archa | E21B 43/123 |

OTHER PUBLICATIONS

Lu et al. (Gas Lift Optimization Using Proxy Functions in Reservoir Simulation, SPE, 2012, pp. 109-119) (Year: 2012).*

Berkenkamp et al., "Bayesian Optimization with Safety Constraints: Safe and Automatic Parameter Tuning in Robotics", Learning & Adaptive Systems Group, Department of Computer Science, Feb. 14, 2016, 9 pages.

International Application No. PCT/US2019/040334, International Search Report and Written Opinion, Mailed On Apr. 1, 2020, 13 pages.

Snoek et al., "Scalable Bayesian Optimization Using Deep Neural Networks", Harvard University, School of Engineering and Applied Sciences, arXiv:1502.05700v2 [stat.ML], Jul. 13, 2015, 13 pages.

* cited by examiner

MULTI-AGENT, MULTI-OBJECTIVE WELLBORE GAS-LIFT OPTIMIZATION

TECHNICAL FIELD

The present disclosure relates generally to hydrocarbon fluid production. More specifically, but not by way of limitation, this disclosure relates to real-time optimized control of gas-lift parameters during production from a wellbore.

BACKGROUND

A well can include a wellbore drilled through a subterranean formation. The subterranean formation can include a rock matrix permeated by the oil that is to be extracted. The oil distributed through the rock matrix can be referred to as a reservoir. Reservoirs are often modeled with standard statistical techniques in order to make projections or determine parameter values that can be used in hydrocarbon drilling or production to maximize the yield. As one example, partial differential equations referred to as the "black-oil" equations can be used to model a reservoir based on production ratios and other production data.

One method of augmenting oil production from a reservoir is to use artificial gas lift. Artificial gas lift involves injecting gas into the production string, or tubing, to decrease the density of the fluid, thereby decreasing the hydrostatic head to allow the reservoir pressure to act more favorably on the oil being lifted to the surface. This gas injection can be accomplished by pumping or forcing gas down the annulus between the production tubing and the casing of the well and then into the production tubing. Gas bubbles mix with the reservoir fluids, thus reducing the overall density of the mixture and improving lift.

DETAILED DESCRIPTION

Certain aspects and features of the present disclosure relate to a system that improves, and makes more efficient, the projection of optimized values for controllable artificial gas-lift parameters such as gas-lift injection rate and choke size. The controllable parameters can be computed, taking into account reservoir data and a physics-based or machine learning or hybrid physics-based machine learning reservoir model. The parameters can be utilized for real-time control and automation in a gas lift system to maximize hydrocarbon production efficiency.

More specifically, some examples of the present disclosure described herein can provide gas-lift optimization using a reservoir production simulation to formulate an objective function based on the amount of oil produced and the rate of gas injected to provide the artificial lift. Optimized gas-lift parameters can be projected using Bayesian optimization (BO). The objective function can be based on simulated hydrocarbon production data generated from the physics-based or machine learning or hybrid physics-based machine learning reservoir model. The reservoir model can be used to generate the necessary data required for the optimization. The examples couple the reservoir model with gas-lift parameters and input minimization using Bayesian optimization. The Bayesian optimization can provide the gas-lift parameters for in-the-field optimization with multiple wells in a cluster of wells drawing from the same reservoir.

In some examples, a system includes a gas supply arrangement to inject gas into one or more wellbores and a computing device in communication with the gas supply arrangement. The computing device includes a memory device with instructions that are executable by the computing device to cause the computing device to receive reservoir data associated with a subterranean reservoir to be penetrated by the wellbores and simulate hydrocarbon production using the reservoir data and using a physics-based or machine learning or hybrid physics-based machine learning model for the subterranean reservoir. The production simulation provides production data. A Bayesian optimization of an objective function of the production data subject to any gas injection constraints is performed to produce gas-lift parameters in response to convergence criteria being met. The gas-lift parameters are applied to the gas supply to control the injection of gas into the wellbore or wellbores.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

Figure 1:
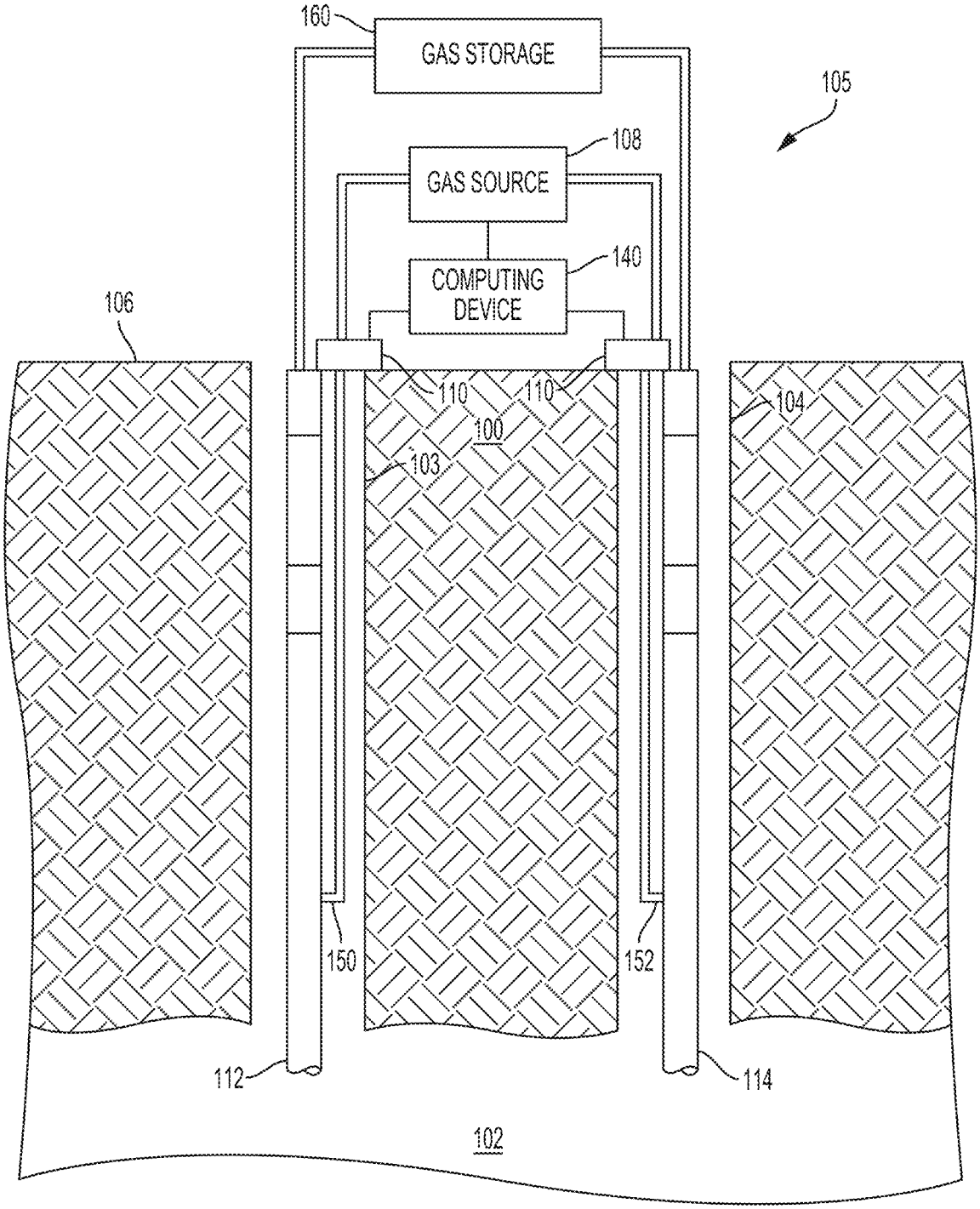
FIG. 1 is a cross-sectional side view of an example reservoir with well cluster that includes a system for creating artificial gas lift in production wells according to some aspects.

FIG. 1 shows a cross-sectional view of an example of subterranean formation 100 with a reservoir 102 that is subject to production through a cluster of wells including wells defined by clustered wellbores 103 and 104. System 105 includes computing device 140 disposed at the surface 106 of subterranean formation 100, as well as gas source 108, which in this example is connected to metering and flow control devices 110. The gas source may include a compressor (not shown). The gas source 108 and a metering and flow control device 110 work together supply gas to a well and can be referred to herein as a "gas supply system," "gas supply arrangement," or a "gas supply." The metering and flow control devices 110 may be connected to or be part of a manifold system (not shown) with multiple gas outlets. Production tubing string 112 is disposed in wellbore 103. Production tubing string 114 is disposed in wellbore 104. It should be noted that while wellbores 103 and 104 are shown as vertical wellbores, either or both wellbores can additionally or alternatively have a substantially horizontal section.

During operation of system 105 of FIG. 1, gas flows downhole from the gas supply and enters production tubing 112 through injection port 150. Gas also enters production tubing 114 through injection port 152. Gas returns to the surface 106 and can be captured in gas storage device 160 to be held for other uses or recycled. In some examples, gas storage device 160 can include a storage tank (not shown).

Still referring to FIG. 1, computing device 140 is connected to gas source 108 and metering and flow control devices 110 to control the gas supply for wellbores 103 and 104. The computing device can also receive and store reservoir data to be used in production simulations. Reservoir data can be received through the production strings with sensors (not shown) that feed signals to computing device 140, from stored files generated from past reservoir monitoring, or even through user input. Data can include characteristics of the reservoir 102 such as viscosity, velocity, and fluid pressure as these quantities spatially vary. The data associated with the subterranean reservoir is used for reservoir modeling and production simulation in computing device 140 according to aspects described herein.

Figure 2:
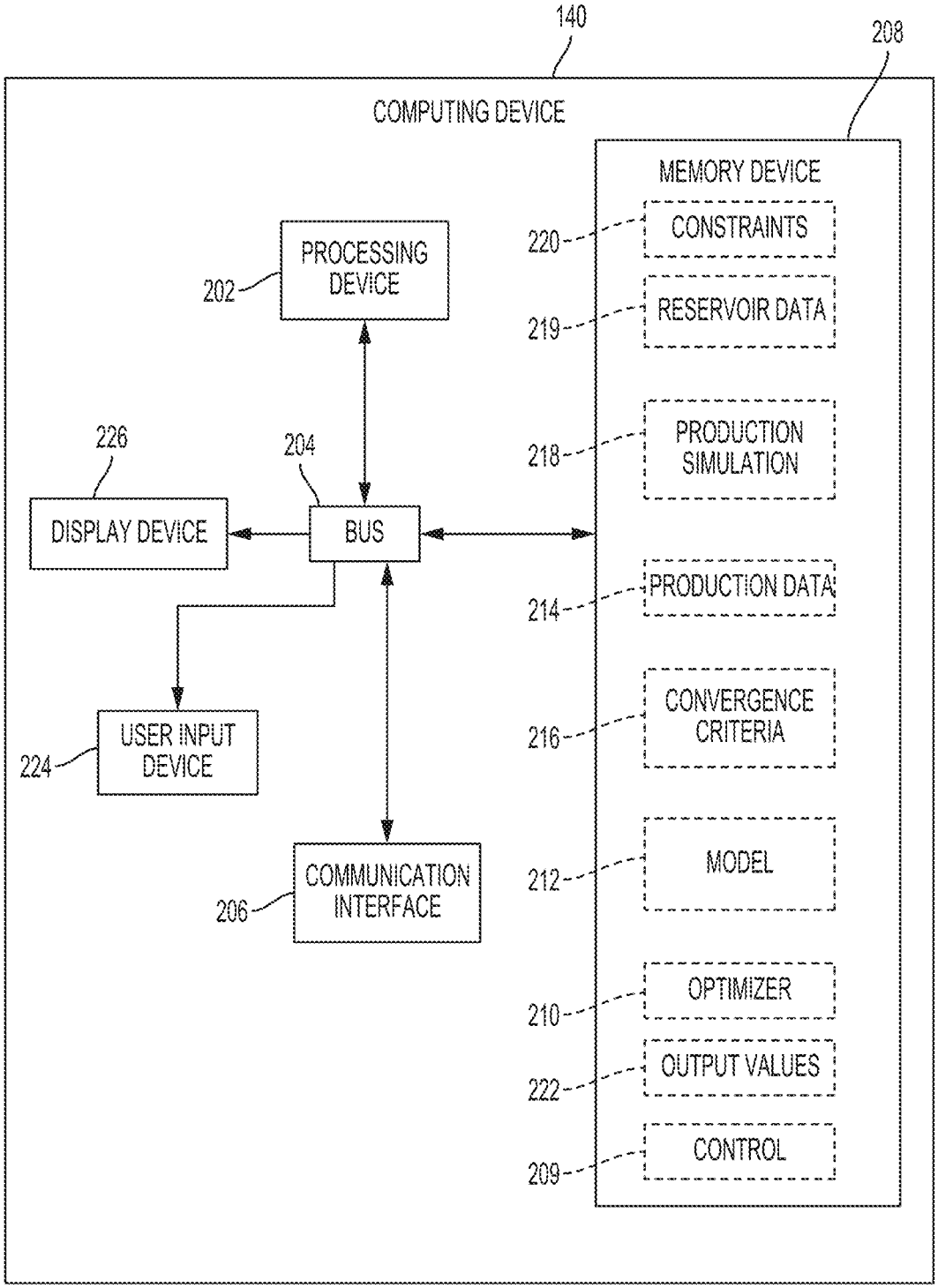
FIG. 2 is block diagram of a computing device for controlling gas-lift parameters according to some aspects.

FIG. 2 depicts a block diagram of an example of a computing device 140 for controlling gas-lift parameters according to some aspects. The computing device 140 includes a processing device 202, a bus 204, a communication interface 206, a memory device 208, a user input device 224, and a display device 226. The processing device 202 can execute one or more operations for implementing some examples of the present disclosure.

In some examples, some or all of the components shown in FIG. 2 can be integrated into a single structure, such as a single housing. In other examples, some or all of the components shown in FIG. 2 can be distributed (e.g., in separate housings) and in communication with each other.

As mentioned above, the processing device 202 can execute one or more operations for optimizing gas lift. The processing device 202 can execute instructions stored in the memory device 208 to perform the operations. The processing device 202 can include one processing device or multiple processing devices. Non-limiting examples of the processing device 202 include a field-programmable gate array ("FPGA"), an application-specific integrated circuit ("ASIC"), a microprocessing device, etc.

The processing device 202 shown in FIG. 2 is communicatively coupled to the memory device 208 via the bus 204. The non-transitory memory device 208 may include any type of memory device that retains stored information when powered off. Non-limiting examples of the memory device 208 include electrically erasable and programmable read-only memory ("EEPROM"), flash memory, or any other type of non-volatile memory.

In some examples, at least some of the memory device 208 can include a non-transitory computer-readable medium from which the processing device 202 can read instructions. A computer-readable medium can include electronic, optical, magnetic, or other storage devices capable of providing the processing device 202 with computer-readable instructions or other program code. Non-limiting examples of a computer-readable medium include (but are not limited to) magnetic disk(s), memory chip(s), read-only memory (ROM), random-access memory ("RAM"), an ASIC, a configured processing device, optical storage, or any other medium from which a computer processing device can read instructions. The instructions can include processing device-specific instructions generated by a compiler or an interpreter from code written in any suitable computer-programming language, including, for example, C, C++, C#, etc.

Still referring to the example shown in FIG. 2, the memory device 208 includes stored values for constraints 220 to be used in optimizing controllable gas-lift parameters. The maximum gas-lift capacity of the system is one example of a constraint. The memory device 208 includes computer program code instructions 209 for controlling the gas supply for the wells of a well cluster. The instructions for controlling the gas supply may include a proportional-integral-derivative (PID) controller.

Memory device 208, in this example, includes a physics-based or machine learning or hybrid physics-based machine learning model 212 of the reservoir 102. Reservoir data 219 is also stored in memory device 208 and can be used with the physics-based or machine learning or hybrid physics-based machine learning model 212 to run a production simulation. Production simulation program code instructions 218 are stored in memory device 208. The production simulation produces production data 214, which is also stored in memory device 208. The memory device 208 in this example includes an optimizer 210. The optimizer can be, for example, computer program code instructions to implement Bayesian optimization of an objective function of the production data to produce optimum values for controllable gas-lift parameters. Results from the optimizer can be stored as controllable output values 222 in the memory device 208. Optimizer 210 can optimize the objective function subject to convergence criteria 216 to produce output values 222.

In some examples, the computing device 140 includes a communication interface 206. The communication interface 206 can represent one or more components that facilitate a network connection or otherwise facilitate communication between electronic devices. Examples include, but are not limited to, wired interfaces such as Ethernet, USB, IEEE 1394, and/or wireless interfaces such as IEEE 802.11, Bluetooth, near-field communication (NFC) interfaces, RFID interfaces, or radio interfaces for accessing cellular telephone networks (e.g., transceiver/antenna for accessing a CDMA, GSM, UMTS, or other mobile communications network).

In some examples, the computing device 140 includes a user input device 224. The user input device 224 can represent one or more components used to input data. Examples of the user input device 224 can include a keyboard, mouse, touchpad, button, or touch-screen display, etc. In some examples, the computing device 140 includes a display device 226. Examples of the display device 226 can include a liquid-crystal display (LCD), a television, a computer monitor, a touch-screen display, etc. In some examples, the user input device 224 and the display device 226 can be a single device, such as a touch-screen display.

Figure 3:
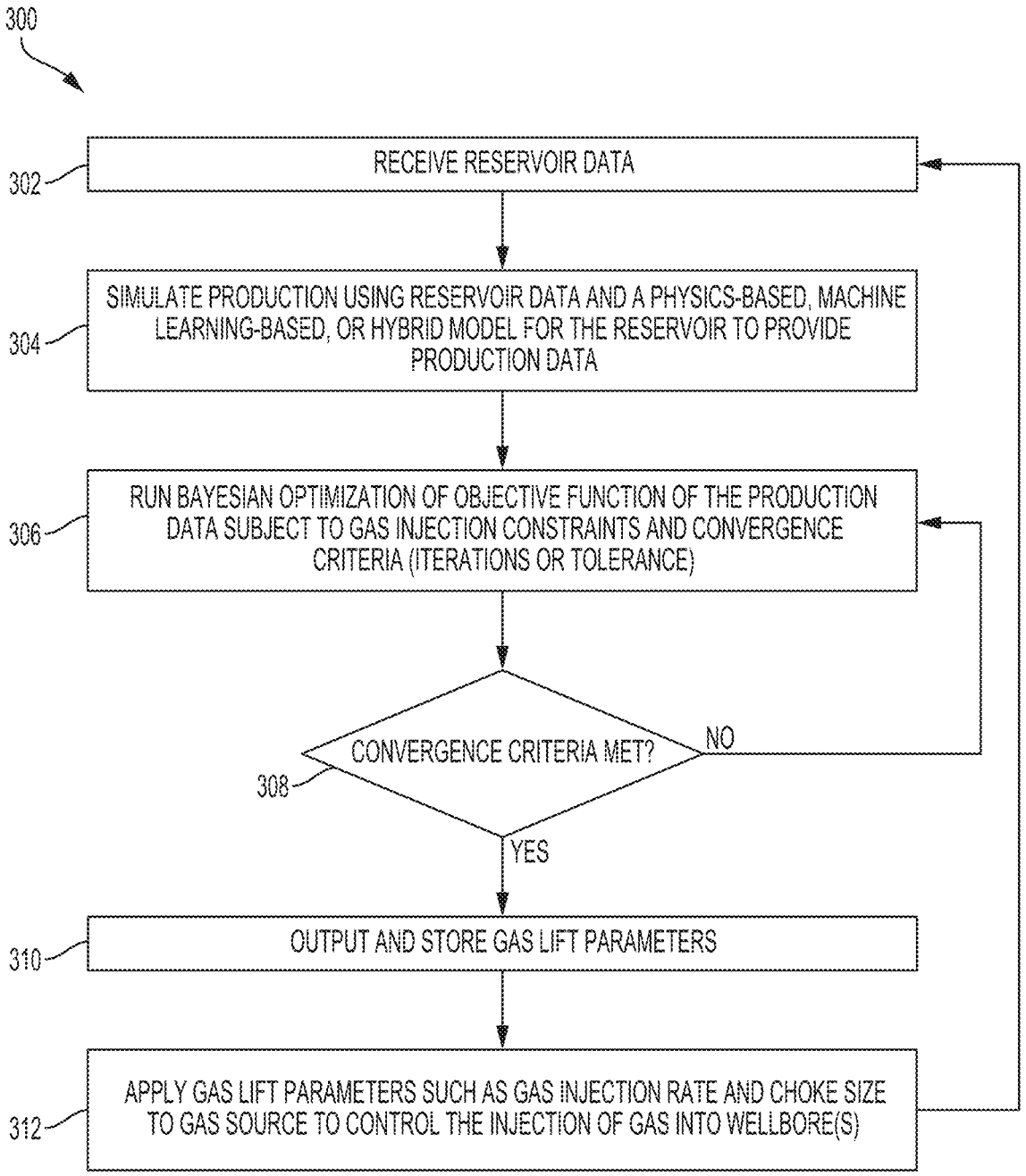
FIG. 3 is a flowchart illustrating a process for controlling a gas lift system according some aspects.

FIG. 3 is a flowchart illustrating a process 300 for controlling a gas lift system according some aspects. At block 302, reservoir data 219 is received by computing device 140. At block 304, processing device 202 simulates production using the reservoir data 219 and the physics-based or machine learning or hybrid physics-based machine learning model 212 with the reservoir data to provide production data 214. At block 306, processing device 202 runs a Bayesian optimization of an objective function of the production data 214 subject to gas injection constraints 220 and convergence criteria 216. The processing device in this example runs the Bayesian optimization using optimizer 210. As examples, the convergence criteria can include a maximum number of iterations of the optimizer, convergence within a specified tolerance of maximum production rate, convergence within a specified range of a minimum friction value for the production tubing, or a combination of any or all of these. If the convergence criteria are met at block 308, the processing device outputs and stores gas-lift parameters at block 310 as output values 222. If convergence criteria are not met at block 308, Bayesian optimization iterations continue at block 306. The gas-lift parameters are applied to the gas source at block 312 to control the injection of gas into the wellbore. In some examples, the gas-lift parameters include gas injection rate, choke size, or both.

Process 300 of FIG. 3 uses Bayesian optimization to model production with optimal parameters for artificial gas lift. Production is a function gas injection rate, which can be constant or function of time. Optimum gas injection rate is herein considered to be the rate needed to maximize production and minimize the friction in the production tubing. The optimal choke size for purposes of the examples described herein is the size needed to avoid back pressure at a gas storage point, for example, gas storage device 160 in FIG. 1.

The example process shown in FIG. 3 can be used to project the gas-lift parameters that maximize efficiency in the sense that the projected parameters are the values that should maximize production while minimizing input. Since oil produced determines revenue and gas input is a variable cost, these values can to at least some extent be treated as the values that will maximize profit. These relationships provide the objective function that is used for Bayesian optimization as described herein. An objective function is sometimes also referred to as a "cost function."

Figure 4:
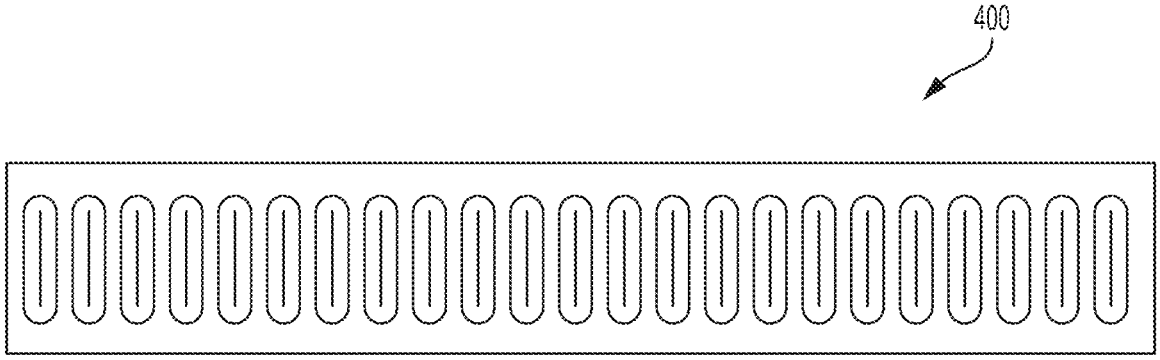
FIG. 4 is a graphical representation of a pressure contours along fractures of a reservoir as modeled according to some aspects.
Figure 5A:
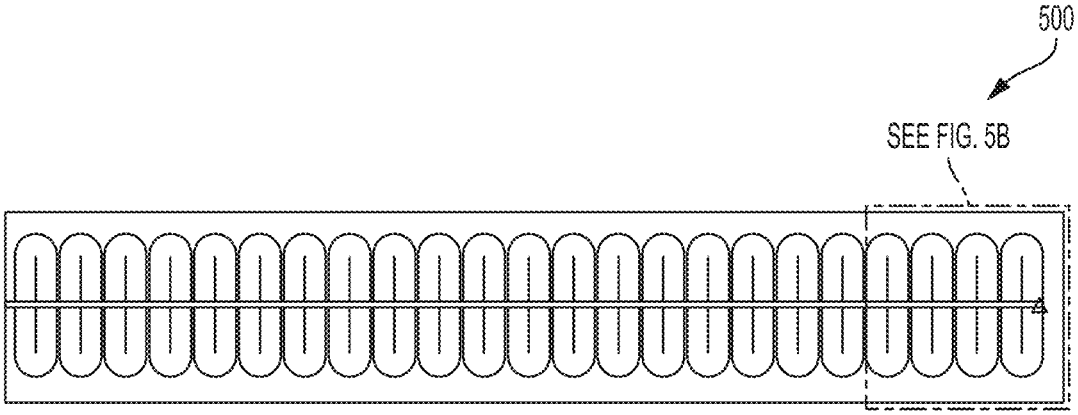
FIG. 5A and FIG. 5B are, respectively, a schematic representation of the pressure contours of FIG. 4 and a detailed graphical representation of a portion of that schematic representation.
Figure 5B:
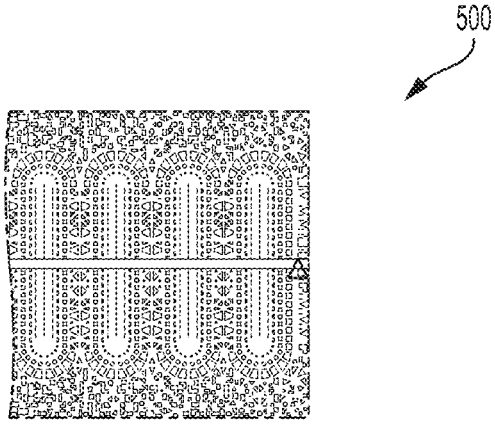

One example of a process described herein can be used for a well with a reservoir model including 12 layers with permeability of 0.002 mD, porosity of 25%, initial water saturation of 0.2, initial pressure of 3500 psia, 23 hydraulic fractures with half-length of 500 ft, an aperture of 0.1 in, conductivity at a perf of 3 mD, and porosity of 30%. FIG. 4 is a graphical representation 400 of the pressure contours along the 23 fractures as produced with Nexus® reservoir simulation software. FIG. 5A is a schematic representation 500 of the fractures and FIG. 5B is a close-up view of a portion of FIG. 5A so that an unstructured, superimposed grid is visible. The projected optimal gas injection rate in this case using the example process described herein was 517.55 Mscf/day. The Bayesian optimization projected the optimal parameters with nine observations. The Bayesian optimization projected a maximum efficiency that would result in profit of $337.44 million at the optimal gas injection rate of 517.55 Mscf/day.

Figure 6:
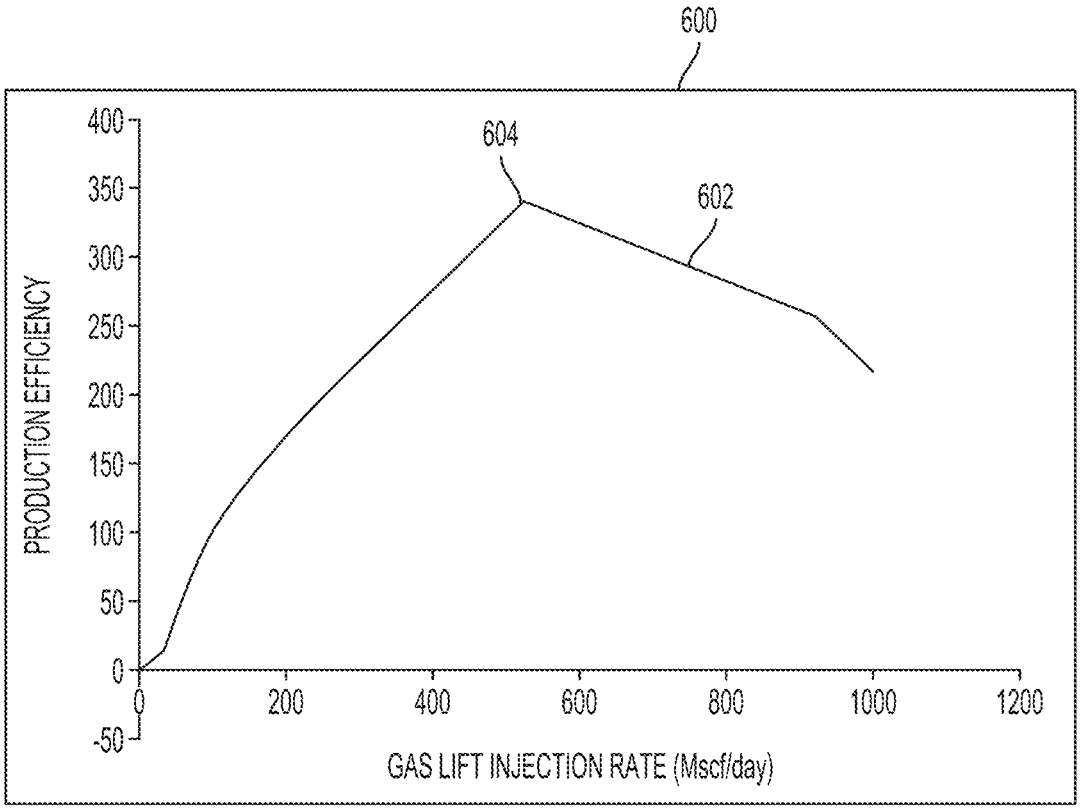
FIG. 6 is a graph of production efficiency as a function of gas-lift injection rate for an example well and reservoir according to some aspects.

FIG. 6 shows a graph 600 the actual production rate as a function of gas injection rate for the reservoir modeled as described above. Efficiency is plotted on the y-axis and gas-lift injection rate is plotted on the x-axis. Line 602 illustrates the actual gas-lift augmented production and point 604 is where maximum efficiency occurs. The projection made using the Bayesian optimization is very close to the actual best gas injection rate.

Figure 7:
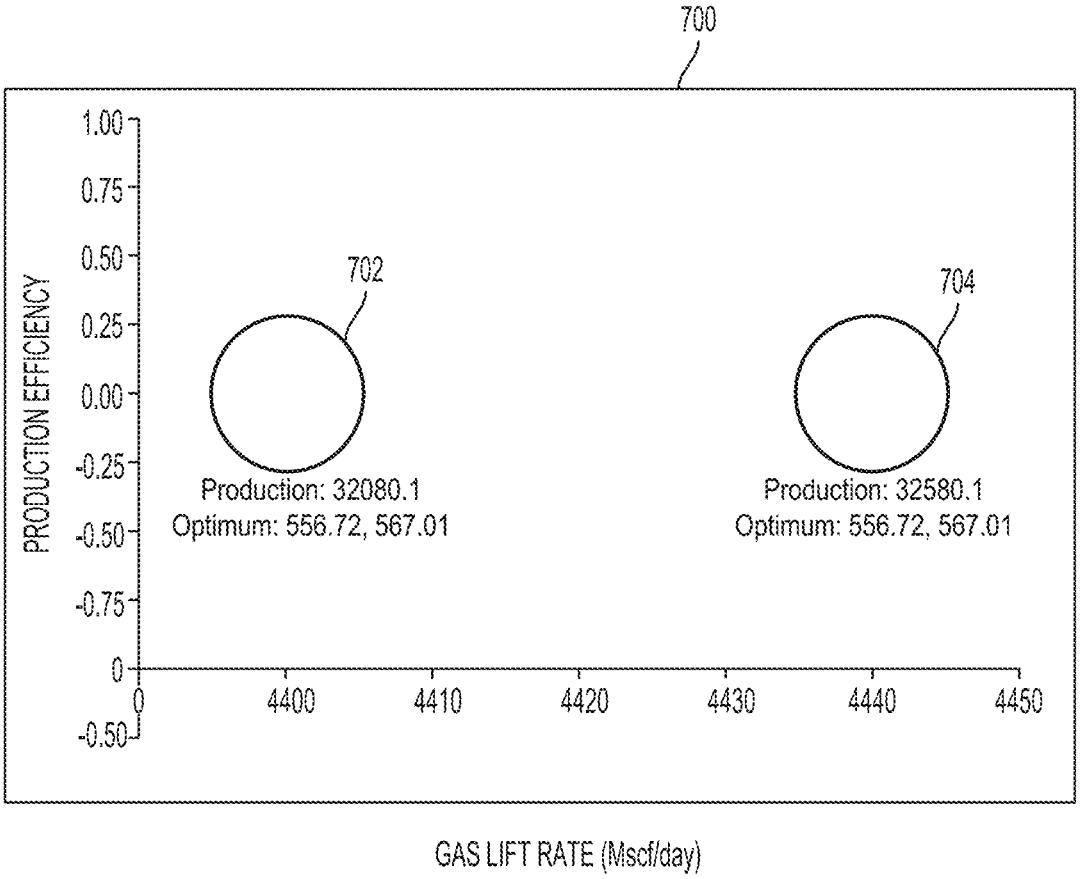
FIG. 7 is a graph of production efficiency as a function of gas-lift injection rate for an example well and reservoir according to some aspects.

FIG. 7 shows a graph 700 of production efficiency as a function of gas-lift injection rate for an example well and reservoir according to some aspects. Efficiency is plotted on the y-axis and gas-lift injection rate is plotted on the x-axis. Point 702 illustrates the actual gas-lift augmented production 325080.1 of a first well, having an optimum range of production between 556.72 and 567.01 and point 704 illustrates the actual gas-lift augmented production 325080.1 of a second well, having corresponding optimum range of production between 556.72 and 567.01. The projection made using the Bayesian optimization is very close to the actual best gas injection rate based on the corresponding gas lift and production benefit parameters for the two wells operating in a reservoir.

Figure 8:
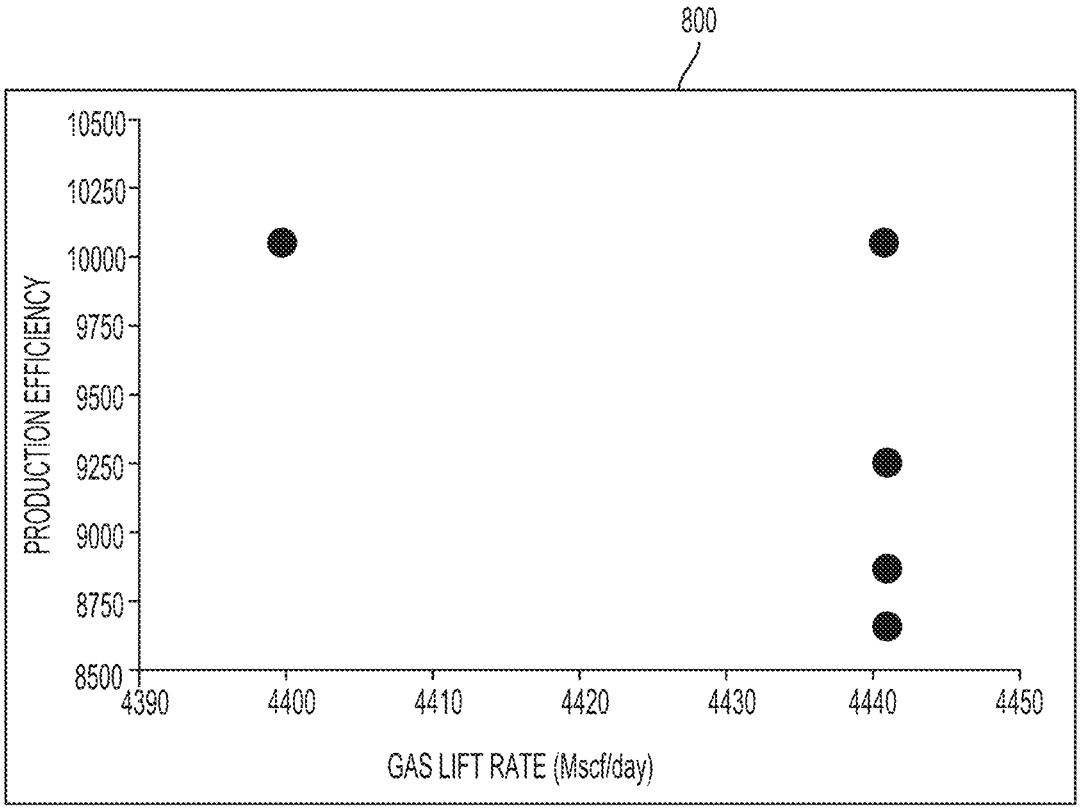
FIG. 8 is a graph of production efficiency as a function of gas-lift injection rate for an example well and reservoir according to some aspects.

FIG. 8 shows a graph 800 of production efficiency as a function of gas-lift injection rate for wells and reservoirs according to some aspects. Efficiency is plotted on the y-axis and gas-lift injection rate is plotted on the x-axis. In this example, the multi-agent, multi-objective Bayesian optimization is applied to five wells associated with two clusters.

Figure 9:
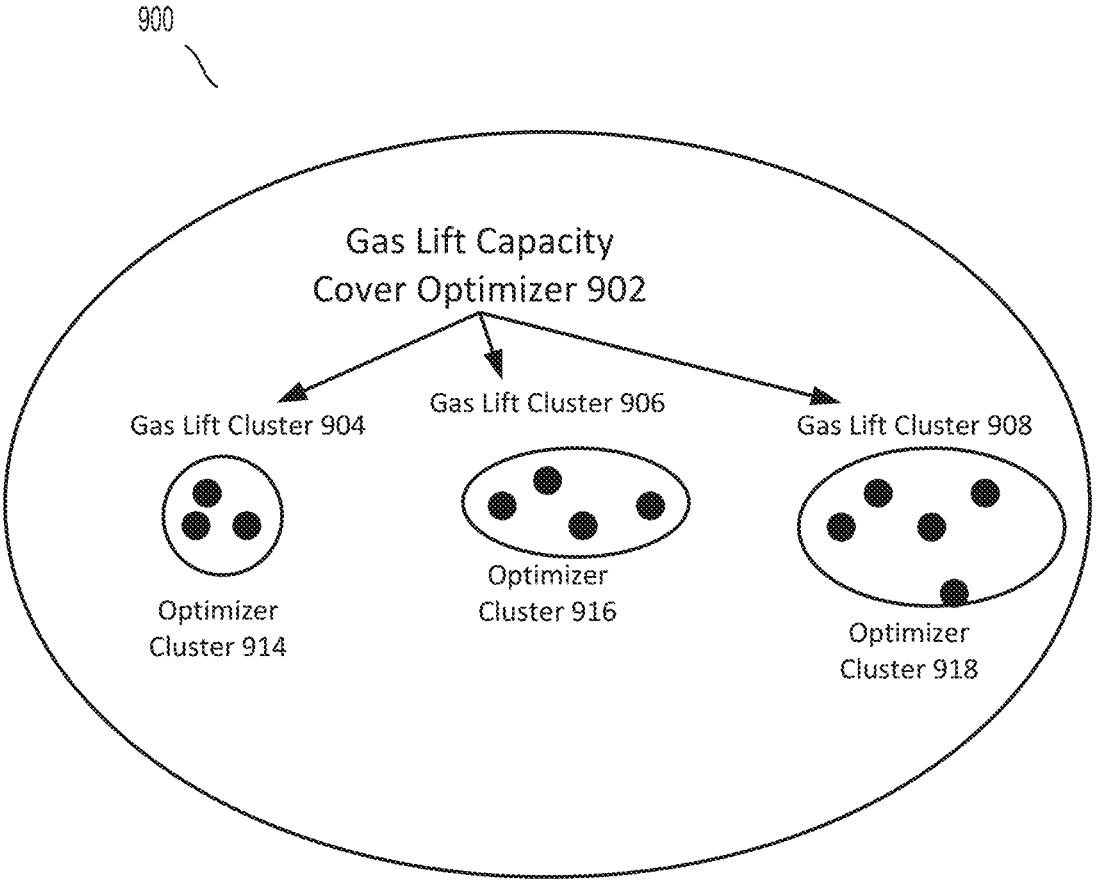
FIG. 9 is an example of a system of multi-agent, multi-objective well clusters arranged for creating artificial gas lift in production wells according to some aspects.

FIG. 9 shows an example of a system 900 of multi-agent, multi-objective well clusters arranged for creating artificial gas lift in production wells according to some aspects. In this example, gas-lift capacity cover optimizer 902 applies the multi-agent, multi-objective Bayesian optimization to gas lift clusters 904, 906, and 908. Gas lift cluster 904 applies the multi-agent, multi-objective Bayesian optimization to the three wells associated with optimizer cluster 914. Similarly, gas lift 906 applies the multi-agent, multi-objective Bayesian optimization to the four wells show in optimizer cluster 916, and gas lift 908 applies the multi-agent, multi-objective Bayesian optimization to the five wells shown in optimizer cluster 918. In this example, each of the gas lift clusters 904, 906, and 908 provides multi-agent, multi-objective Bayesian optimization, which can be applied by a robot operating system (ROS) (not shown). Further, the gas-lift capacity cover optimizer 902 provides a second level of multi-agent, multi-objective Bayesian optimization for the combination of clusters.

In some examples, a ROS provides software that enables robots to perform gas lift functions. For example, in the multi-agent framework, ROS devices provides agent to agent communication and multi-objective optimization capabilities. In some examples, a ROS robot automates capabilities described herein, e.g., sensing and actuation of gas-lift controls. It may be advantageous to implement optimized parameters discussed herein using robots to improve the efficiency and accuracy of the multi-agent, multi-objective Bayesian optimization.

In some examples, the gas-lift capacity cover optimizer 902 can provide multi-agent, multi-objective Bayesian optimization for any two of gas lift clusters 904, 906, 908. Alternatively (or in addition to), the gas-lift capacity cover optimizer 902 can provide multi-agent, multi-objective Bayesian optimization gas lift clusters 904, 906, 908, and one or more additional clusters (not shown). Further, in some examples, the gas-lift capacity cover optimizer 902 may be one of a plurality of similar gas-lift capacity covers, which can correspond to a group of gas-lift capacity covers. In such an example, the gas-lift capacity cover optimizers can provide multi-agent, multi-objective Bayesian optimization for a third level of multi-agent, multi-objective Bayesian optimization. It should be appreciated that any number of levels of well clusters, sub-well clusters, or wells can be grouped according to an optimal arrangement for creating artificial gas lift in production wells according to some embodiments.

Figure 10:
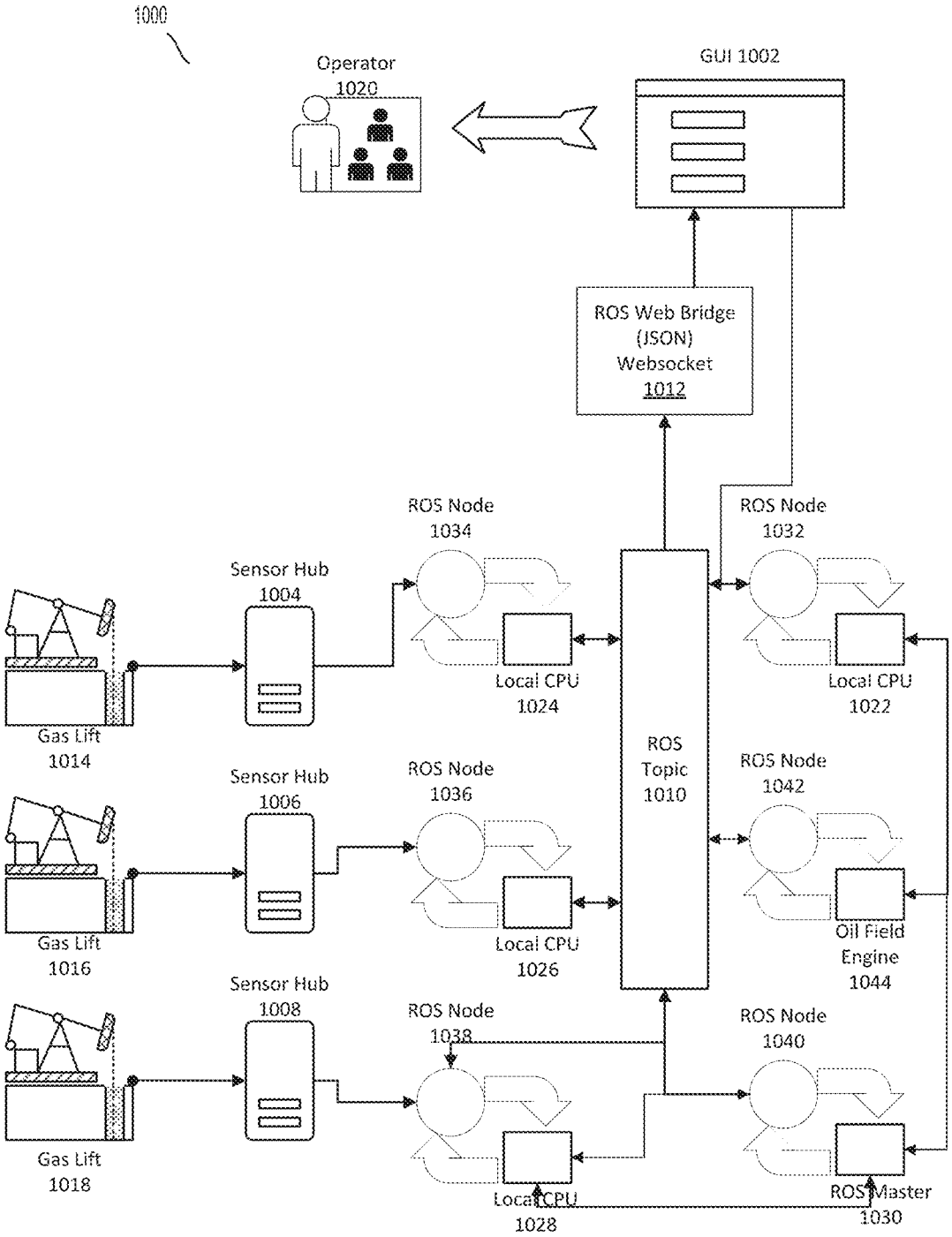
FIG. 10 is a schematic diagram of an example of a system of multi-agent, multi-objective well clusters arranged for creating artificial gas lift in production wells according to some aspects.

FIG. 10 shows a schematic diagram of a system 1000 of multi-agent, multi-objective well clusters arranged for creating artificial gas lift in production wells according to some aspects. The multi-agent, multi-objective well system 1000 shows gas lifts 1014, 1016, and 1018 communicatively coupled to sensor hubs 1004, 1006, and 1008, respectively. Sensor hubs 1004, 1006, and 1008 provides sampled gas-lift parameters, e.g., pressure, temperature, flow rate, viscosity, depth, penetration rate, drill trajectory, velocity, etc. to ROS Nodes 1034, 1036, and 1038, respectively.

In some examples, the sensor hubs 1004, 1006, and 1008 may provide sensed gas-lift parameters or other sampled data using Message Queuing Telemetry Transport (MQTT) protocol to send sensed parameters. In other examples, the sensor hubs 1004, 1006, and 1008 can send gas-lift parameters using TCP/IP protocols. In some examples, the sensor hubs 1004, 1006, and 1008 may provide sensed gas-lift parameters by another middleware messaging protocol, e.g., advanced message queuing protocol (AMQP), streaming text oriented messaging protocol (STOMP), web application messaging protocol (WAMP), or any other suitable messaging-oriented middleware.

As described above, the ROS Nodes 1034, 1036, and 1038 receive gas-lift parameters. The ROS Nodes 1014, 1016, and 1018 are communicatively coupled to local CPUs 1024, 1026, and 1028, respectively. As discussed above, with respect to FIGS. 1 and 2, the local CPUs 1024, 1026, and 1028 can be any suitable computing device described herein. In this example, the local CPUs 1024, 1026, and 1028 provides the multi-agent, multi-objective Bayesian optimization according to techniques discussed herein. Further, the local CPUs 1024, 1026, and 1028 can provide the multi-agent, multi-objective Bayesian optimization associated with their respective gas lifts, 1014, 1016, and 1018, respectively, to ROS Node 1040. The ROS Node 1040 communicates with the ROS master 1030.

In some examples, the ROS master 1030 registers each ROS node in the ROS system. For example, the ROS master 1030 can name each node, monitoring each node(s) for their respective publications and subscriptions to topics, e.g., named buses that communicate published messages to subscribers of the topic. Further, the ROS master 1030 can store, retrieve, or distribute information associated with ROS nodes stored in a client library, e.g., an XML-based API. And, in this example, the local CPUs 1024, 1026, 1028 and their respective ROS nodes 1034, 1036, and 1038, publish to ROS topic 1010. In some examples, ROS topic 1010 represents the multi-agent, multi-objective Bayesian optimization calculated by the local CPU 1024, 1026, or 1028. However, in some examples, the ROS topic 1010 can be one or more of the sensed parameters discussed above.

The ROS master 1030 provides the tracked historical data associated with respective nodes 1034, 1036, and 1038 and ROS topic 1010 to the oil field engine 1044. In some examples, the oil field engine 1044 provides information to the ROS topic 1010 via ROS node 1042 to coordinate an optimal gas lift production among one or more wells or well clusters. In some examples, the oil field engine 1044, like the gas-lift cover optimizer 902 discussed with respect to FIG. 9, provides information to ROS topic 1010 based on multi-agent, multi-objective Bayesian optimization determinations may by ROS node 1032. Further, in some examples, ROS node 1032 can provide information associated with a single well, a single well cluster, a cluster or well clusters, or any of the examples discussed herein.

The ROS topic 1010 communicates multi-agent, multi-objective Bayesian optimization information to the ROS web bridge, which uses a communications protocol, e.g., a websocket or javascript open notation (JSON), to create and transmit graphical user interface (GUI) 1002, e.g., a single page application (SPA). GUI 1002 is output to any suitable display to operator 1020 to notify the operator 1020 of gas-lift controls to achieve a recommended amount of gas lift based on determined multi-agent, multi-objective parameters. Alternatively, operator 1020 can be replaced by an autonomous or robotic system that enables a robot or another autonomous computing device to perform the recommended gas-lift controls.

Figure 11:
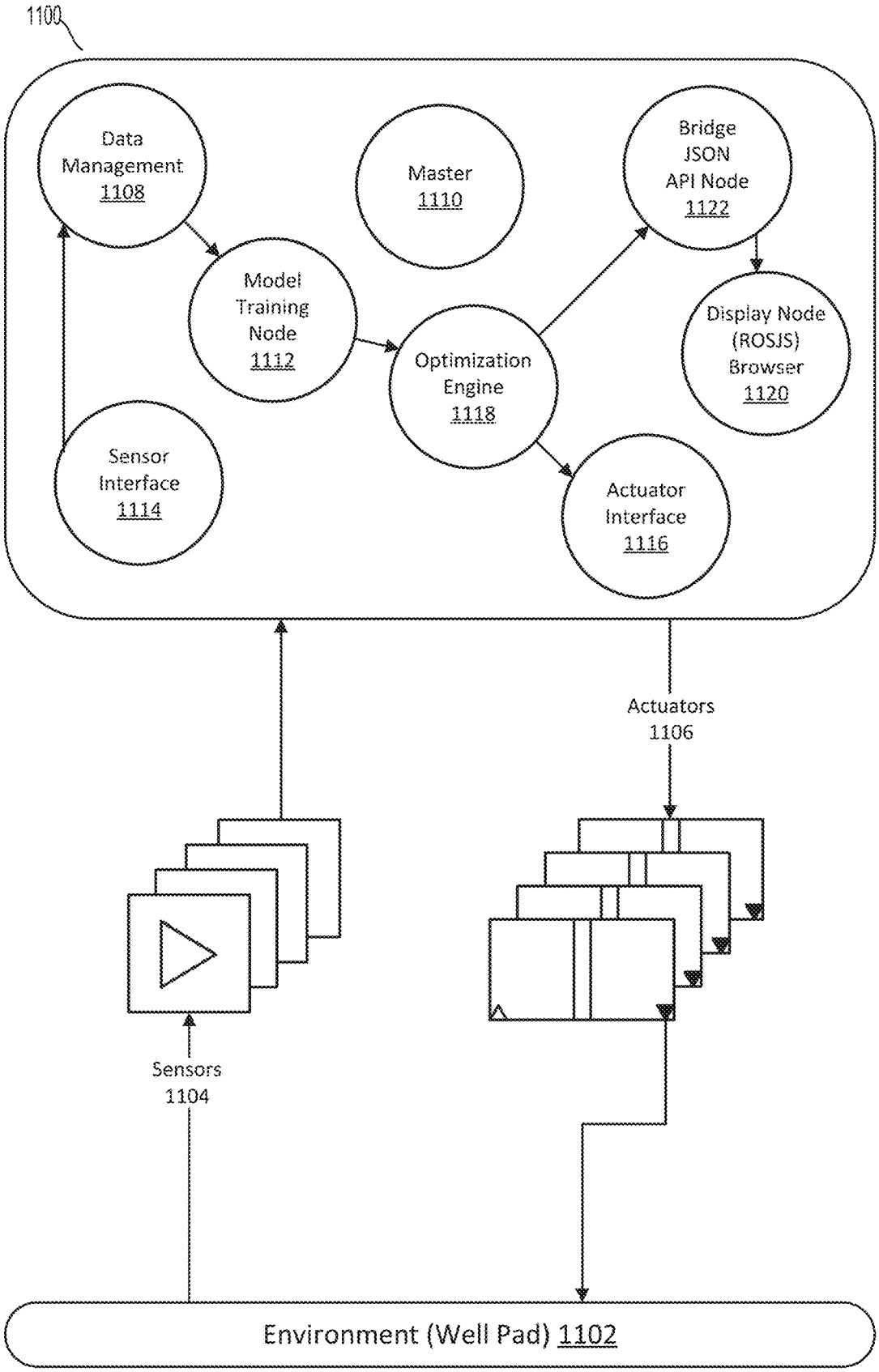
FIG. 11 is a system of multi-agent, multi-objective well clusters arranged for creating artificial gas lift in production wells.

FIG. 11 shows a system 1100 of multi-agent, multi-objective well clusters arranged for creating artificial gas lift in production wells. In this example, the system 1100 receives sensor signals from sensors 1104 and provides the multi-agent, multi-objective parameters to actuators 1106 in a closed loop control environment. Like the sensor hubs 1004, 1006, and 1008 discussed above with respect to FIG. 10, the sensors 1104 provides gas-lift parameters to the system 1100.

The system 1100, which is enabled to run by master processing device 1110, receives the sensor signals from sensors 1104 via the sensor interface 1114 and transmits the sensed data to the data management module 1108. The data management module 1108 provides the information to the model training node 1112, which in turn provides the data and the model parameters to the optimization engine 1118. The optimization engine performs the function and provides the artificially-created simulation's recommendation to both the bridge JSON API node 1122 and the actuator interface 1116. The bridge JSON API node 1122 sends the recommendation to the display node ROSJS browser 1120, where the information may be displayed to an operator, e.g., operator 1020 discussed above with respect to FIG. 10, or to an automated robotic gas control system. Further, the actuator interface 1116 may provide gas-control instructions to perform the automated gas controls to actuators 1106 to be carried out in the associated environment, well pad 1102.

Figure 12:
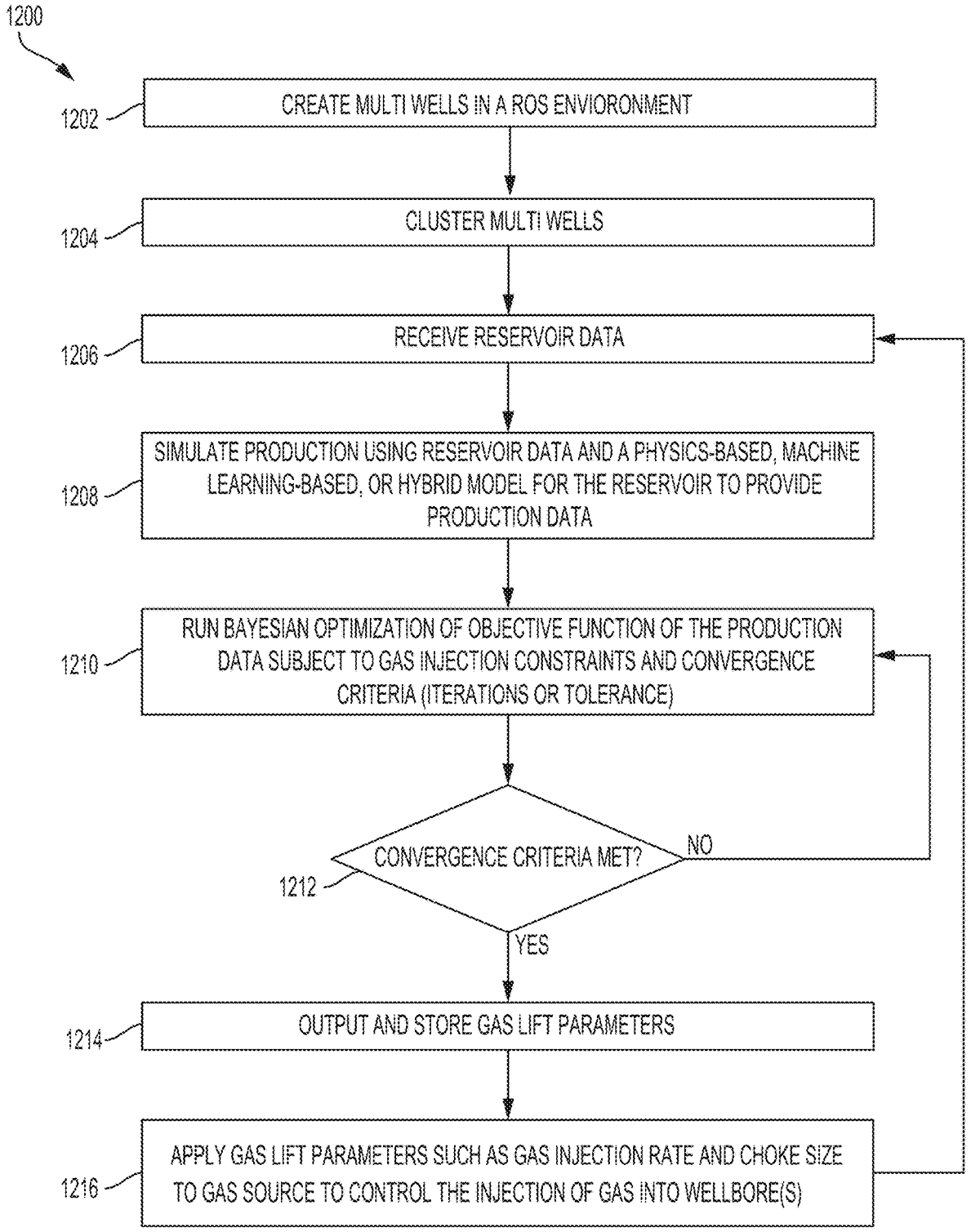
FIG. 12 is a flowchart illustrating a process for controlling a gas lift system according some aspects.

FIG. 12 is a flowchart illustrating a process 1200 for controlling a gas lift system according some aspects. At block 1202, multi wells are created in a ROS environment by computing device 140. At block 1204, the multi wells are clustered, either manually or by computing device 140. At block 1206, reservoir data 219 is received by computing device 140. At block 1208, processing device 202 simulates production using the reservoir data 219 and the physics-based or machine learning or hybrid physics-based machine learning model 212 with the reservoir data to provide production data 214. At block 1210, processing device 202 runs a Bayesian optimization of an objective function of the production data 214 subject to gas injection constraints 220 and convergence criteria 216. The processing device in this example runs the Bayesian optimization using optimizer 210. As examples, the convergence criteria can include a maximum number of iterations of the optimizer, convergence within a specified tolerance of maximum production rate, convergence within a specified range of a minimum friction value for the production tubing, or a combination of any or all of these. If the convergence criteria are met at block 1212, the processing device outputs and stores gas-lift parameters at block 1214 as output values 222. If convergence criteria are not met at block 1212, Bayesian optimization iterations continue at block 1210. The gas-lift parameters are applied to the gas source at block 1216 to control the injection of gas into the wellbore. In some examples, the gas-lift parameters include gas injection rate, choke size, or both.

Process 1200 of FIG. 12 uses Bayesian optimization to model production with optimal parameters for artificial gas lift. Production is a function gas injection rate, which can be constant or function of time. Optimum gas injection rate is herein considered to be the rate needed to maximize production and minimize the friction in the production tubing. The optimal choke size for purposes of the examples described herein is the size needed to avoid back pressure at a gas storage point, for example, gas storage device 160 in FIG. 1.

The process of FIG. 12 can be used to project the gas-lift parameters that maximize efficiency in the sense that the projected parameters are the values that should maximize production while minimizing input. Since oil produced determines revenue and gas input is a variable cost, these values can to at least some extent be treated as the values that will maximize profit. These relationships provide the objective function that is used for Bayesian optimization as described herein. An objective function is sometimes also referred to as a "cost function." The cost function may include reservoir parameters, bottomhole pressure, etc. to determine oil, gas, and water production. Further, the production of oil, gas, and water can be employed by the cost function to determine a production benefit by offsetting predicted revenues by gas lift expenses.

Unless specifically stated otherwise, it is appreciated that throughout this specification that terms such as "processing," "calculating," "determining," "operations," or the like refer to actions or processes of a computing device, such as the controller or processing device described herein that can manipulate or transform data represented as physical electronic or magnetic quantities within memories, registers, or other information storage devices, transmission devices, or display devices. The order of the process blocks presented in the examples above can be varied, for example, blocks can be re-ordered, combined, or broken into sub-blocks. Certain blocks or processes can be performed in parallel.

Further, the use of "configured to" herein is meant as open and inclusive language that does not foreclose devices configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Elements that are described as "connected," "connectable," or with similar terms can be connected directly or through intervening elements.

By using certain examples of the present disclosure, multi-agent, multi-objective well clusters can be arranged to determine an optimal amount of artificial gas lift in production wells processes, and used in a variety of contexts to improve performance of wellbore operations.

As used below, any reference to a series of examples is to be understood as a reference to each of those examples disjunctively (e.g., "Examples 1-4" is to be understood as "Examples 1, 2, 3, or 4").

Example 1. A system includes a gas supply arrangement to inject gas into a plurality of wellbores in proximity to production tubing and a computing device in communication with the gas supply arrangement. The computing device includes a non-transitory memory device comprising instructions that are executable by the computing device to cause the computing device to perform operations. The operations include receiving first reservoir data associated with a first subterranean reservoir to be penetrated by a first wellbore, simulating production using the first reservoir data associated with the first subterranean reservoir and using a physics-based model, a machine learning model, or a hybrid physics-based machine learning model for the first subterranean reservoir to provide first production data, receiving second reservoir data associated with a second subterranean reservoir to be penetrated by a second wellbore, simulating production using the second reservoir data associated with the second subterranean reservoir and using the physics-based model, the machine learning model, or the hybrid physics-based machine learning model for the second subterranean reservoir to provide second production data, performing a Bayesian optimization of an objective function of the first and second production data subject to gas injection constraints and convergence criteria to produce gas lift parameters, and applying the gas lift parameters to the gas supply arrangement in response to the convergence criteria being met to control an injection of gas into at least one wellbore of the plurality of wellbores.

Example 2. The system of example 1 wherein the plurality of wellbores comprise a plurality of clustered wellbores. The system further includes a production tubing string disposed in the at least one wellbore of the plurality of clustered wellbores, an injection port connected to the production tubing string to inject gas into the production tubing string downhole, and a gas storage device connected to the production tubing string.

Example 3. The system of example(s) 1-2 wherein the gas lift parameters include gas injection rate and choke size.

Example 4. The system of example(s) 1-3 wherein the gas injection rate is a constant or a function of time.

Example 5. The system of example(s) 1-4 wherein the convergence criteria comprise a maximum number of iterations and a convergence within a specified tolerance to a maximum production rate and a minimum friction value for the production tubing.

Example 6. The system of example(s) 1-5 wherein the plurality of wellbores comprise a plurality of clustered wellbores. The operations further include transmitting a signal to a robot associated with at least one of the plurality of clustered wellbores to perform a gas lift control based on the gas lift parameters.

Example 7. The system of example(s) 1-6 wherein the robot associated with at least one of the plurality of clustered wellbores is a first robot, wherein the at least one of the plurality of clustered wellbores is the first wellbore, and wherein a second robot is associated with the second wellbore. The system further includes peer-to-peer network, the peer-to-peer network connecting at least the computing device, first robot, and second robot, the first robot having a first sensor, the first sensor to detect the first reservoir data and real-time production data associated with the first wellbore, wherein the first robot transmits the first reservoir data to the computing device through the peer-to-peer network, and the second robot having a second sensor, the second sensor to detect the second reservoir data and real-time production data associated with the second wellbore, wherein the second robot transmits the second reservoir data to the computing device through the peer-to-peer network.

Example 8. A method includes receiving, by a processing device, first reservoir data associated with a first subterranean reservoir to be penetrated by a first wellbore, simulating, by the processing device, production using the first reservoir data associated with the subterranean reservoir and using a physics-based model, a machine learning model, or a hybrid physics-based machine learning model for the first subterranean reservoir to provide first production data, receiving, by the processing device, second reservoir data associated with a second subterranean reservoir to be penetrated by a second wellbore, simulating, by the processing device, production using the second reservoir data associated with the subterranean reservoir and using the physics-based model, the machine learning model, or the hybrid physics-based machine learning model for the second subterranean reservoir to provide second production data, performing, by the processing device, a Bayesian optimization of an objective function of the first and second production data subject to gas injection constraints and convergence criteria to produce gas lift parameters, and applying, by the processing device, the gas lift parameters to a gas supply arrangement in response to the convergence criteria being met to control an injection of gas into the first wellbore or the second wellbore.

Example 9. The method of example 8 wherein a plurality of clustered wellbores includes at least the first wellbore and the second wellbore, the first wellbore and the second wellbore each including a production tubing string. The method further includes injecting gas into the production tubing string downhole, and capturing gas at a gas storage device connected to the production tubing string.

Example 10. The method of example(s) 8-9 wherein the gas lift parameters include gas injection rate and choke size.

Example 11. The method of example(s) 8-10 wherein the gas injection rate is constant or a function of time.

Example 12. The method of example(s) 8-11 wherein the convergence criteria comprise a maximum number of iterations and a convergence within a specified tolerance to a maximum production rate and a minimum friction value for the production tubing.

Example 13. The method of example(s) 8-12 transmitting a signal to a robot associated with at least one of the plurality of clustered wellbores to perform a gas lift control based on the gas lift parameters.

Example 14. The method of example(s) 8-13 wherein the robot is a first robot, wherein the first robot is associated with the first wellbore, and wherein a second robot is associated with the second wellbore. The method further includes connecting, by a peer-to-peer network, at least the processing device, first robot, and second robot, detecting, by the first robot having a first sensor, real-time production data associated with the first wellbore, the real-time production data associated with the first wellbore being the first reservoir data, detecting, by the second robot having a second sensor, real-time production data associated with the second wellbore, the real-time production data associated with the first wellbore being the second reservoir data, transmitting, by the first robot, the first reservoir data to the processing device through the peer-to-peer network, and transmitting, by the second robot, the second reservoir data to the processing device through the peer-to-peer network.

Example 15. A non-transitory computer-readable medium includes instructions that are executable by a processing device for causing the processing device to perform a method. The method includes receiving, by a processing device, first reservoir data associated with a first subterranean reservoir to be penetrated by a first wellbore, simulating, by the processing device, production using the first reservoir data associated with the subterranean reservoir and using a physics-based model, a machine learning model, or a hybrid physics-based machine learning model for the first subterranean reservoir to provide first production data, receiving, by the processing device, second reservoir data associated with a second subterranean reservoir to be penetrated by a second wellbore, simulating, by the processing device, production using the second reservoir data associated with the subterranean reservoir and using the physics-based model, the machine learning model, or the hybrid physics-based machine learning model for the second subterranean reservoir to provide second production data, performing, by the processing device, a Bayesian optimization of an objective function of the first and second production data subject to gas injection constraints and convergence criteria to produce gas lift parameters, and applying, by the processing device, the gas lift parameters to a gas supply arrangement in response to the convergence criteria being met to control an injection of gas into the first wellbore or the second wellbore.

Example 16. The non-transitory computer-readable medium of example 15 wherein a plurality of clustered wellbores includes at least the first wellbore and the second wellbore, the first wellbore and the second wellbore each including a production tubing string. The method further includes injecting gas into the production tubing string downhole, and capturing gas at a gas storage device connected to the production tubing string.

Example 17. The non-transitory computer-readable medium of example(s) 15-16 wherein the gas lift parameters include gas injection rate and choke size, and wherein the gas injection rate is a constant or a function of time.

Example 18. The non-transitory computer-readable medium of example(s) 15-17 wherein the convergence criteria comprise a maximum number of iterations and a convergence within a specified tolerance to a maximum production rate and a minimum friction value for the production tubing.

Example 19. The non-transitory computer-readable medium of example(s) 15-18 wherein the processing device comprises a robotic operating system (ROS). The method further includes transmitting a signal to a robot associated with at least the first wellbore or the second wellbore to perform a gas lift control based on the gas lift parameters.

Example 20. The non-transitory computer-readable medium of example(s) 15-19 wherein the robot is a first robot, wherein the first robot is associated with the first wellbore, and wherein a second robot is associated with the second wellbore. The method further includes connecting, by a peer-to-peer network, at least the processing device, first robot, and second robot, detecting, by the first robot having a first sensor, real-time production data associated with the first wellbore, the real-time production data associated with the first wellbore being the first reservoir data, detecting, by the second robot having a second sensor, real-time production data associated with the second wellbore, the real-time production data associated with the first wellbore being the second reservoir data, transmitting, by the first robot, the first reservoir data to the processing device through the peer-to-peer network, and transmitting, by the second robot, the second reservoir data to the processing device through the peer-to-peer network.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a gas supply arrangement to inject gas into a plurality of wellbores in proximity to production tubing, wherein the plurality of wellbores comprises a plurality of clustered wellbores; and a computing device in communication with the gas supply arrangement, the computing device including a non-transitory memory device comprising instructions that are executable by the computing device to cause the computing device to perform operations comprising:

receiving, from a first robot associated with a first wellbore, first reservoir data associated with a first subterranean reservoir to be penetrated by the first wellbore, the first wellbore being associated with a first cluster of wellbores of the plurality of clustered wellbores;

simulating production using the first reservoir data associated with the first subterranean reservoir and using a physics-based model, a machine learning model, or a hybrid physics-based machine learning model for the first subterranean reservoir to provide first production data;

receiving, from a second robot associated with a second wellbore, second reservoir data associated with a second subterranean reservoir to be penetrated by the second wellbore, the second wellbore being associated with a second cluster of wellbores of the plurality of clustered wellbores;

simulating production using the second reservoir data associated with the second subterranean reservoir and using the physics-based model, the machine learning model, or the hybrid physics-based machine learning model for the second subterranean reservoir to provide second production data;

performing a Bayesian optimization of an objective function of the first and second production data subject to gas injection constraints and convergence criteria to produce gas-lift parameters, the Bayesian optimization being performed for each of the first cluster of wellbores, the second cluster of wellbores, and across the plurality of clustered wellbores; and applying the gas-lift parameters to the gas supply arrangement by performing a gas-lift control using the first robot or the second robot based on the gas-lift parameters in response to the convergence criteria being met to control an injection of gas into at least one wellbore of the plurality of wellbores.

2. The system of claim 1, further comprising:

a production tubing string disposed in the at least one wellbore of the plurality of clustered wellbores;

an injection port connected to the production tubing string to inject gas into the production tubing string downhole; and a gas storage device connected to the production tubing string.

3. The system of claim 1, wherein the gas-lift parameters comprise gas injection rate and choke size.

4. The system of claim 3, wherein the gas injection rate is constant or a function of time.

5. The system of claim 1, wherein the convergence criteria comprise a maximum number of iterations and a convergence within a specified tolerance to a maximum production rate and a minimum friction value for the production tubing.

6. The system of claim 1, the operations further comprising:

transmitting a signal to the first robot or the second robot associated with at least one of the plurality of clustered wellbores to perform the gas-lift control based on the gas-lift parameters.

7. The system of claim 6, wherein the at least one of the plurality of clustered wellbores is the first wellbore, the system further comprising:

the first robot having a first sensor, the first sensor to detect the first reservoir data and receive real-time production data associated with the first wellbore, wherein the first robot transmits the first reservoir data to the computing device; and the second robot having a second sensor, the second sensor to detect the second reservoir data and receive real-time production data associated with the second wellbore, wherein the second robot transmits the second reservoir data to the computing device.

8. A method comprising:

receiving, from a first robot associated with a first wellbore and by a processing device, first reservoir data associated with a first subterranean reservoir to be penetrated by the first wellbore, the first wellbore being associated with a first cluster of wellbores of a plurality of clustered wellbores;

simulating, by the processing device, production using the first reservoir data associated with the first subterranean reservoir and using a physics-based model, a machine learning model, or a hybrid physics-based machine learning model for the first subterranean reservoir to provide first production data;

receiving, from a second robot associated with a second wellbore and by the processing device, second reservoir data associated with a second subterranean reservoir to be penetrated by the second wellbore, the second wellbore being associated with a second cluster of wellbores of the plurality of clustered wellbores;

simulating, by the processing device, production using the second reservoir data associated with the second subterranean reservoir and using the physics-based model, the machine learning model, or the hybrid physics-based machine learning model for the second subterranean reservoir to provide second production data;

performing, by the processing device, a Bayesian optimization of an objective function of the first and second production data subject to gas injection constraints and convergence criteria to produce gas-lift parameters, the Bayesian optimization being performed for each of the first cluster of wellbores, the second cluster of wellbores, and across the plurality of clustered wellbores; and applying, by the processing device, the gas-lift parameters to a gas supply arrangement by performing a gas-lift control using the first robot or the second robot based on the gas-lift parameters in response to the convergence criteria being met to control an injection of gas into the first wellbore or the second wellbore.

9. The method of claim 8, wherein the first wellbore and the second wellbore each include a production tubing string, the method further comprising:

injecting gas into the production tubing string downhole; and capturing gas at a gas storage device connected to the production tubing string.

10. The method of claim 8, wherein the gas-lift parameters comprise gas injection rate and choke size.

11. The method of claim 10, wherein the gas injection rate is constant or a function of time.

12. The method of claim 8, wherein the convergence criteria comprise a maximum number of iterations and a convergence within a specified tolerance to a maximum production rate and a minimum friction value for the production tubing.

13. The method of claim 8, further comprising:

transmitting a signal to the first robot or the second robot associated with at least one of the plurality of clustered wellbores to perform the gas-lift control based on the gas-lift parameters.

14. The method of claim 13, further comprising:

receiving, from the first robot having a first sensor, real-time production data associated with the first wellbore, the real-time production data associated with the first wellbore being the first reservoir data;

receiving, from the second robot having a second sensor, real-time production data associated with the second wellbore, the real-time production data associated with the first wellbore being the second reservoir data;

transmitting, using the first robot, the first reservoir data to the processing device; and transmitting, using the second robot, the second reservoir data to the processing device.

15. A non-transitory computer-readable medium comprising instructions that are executable by a processing device for causing the processing device to perform operations comprising:

receiving, from a first robot associated with a first wellbore and by the processing device, first reservoir data associated with a first subterranean reservoir to be penetrated by the first wellbore, the first wellbore being associated with a first cluster of wellbores of a plurality of clustered wellbores;

simulating, by the processing device, production using the first reservoir data associated with the first subterranean reservoir and using a physics-based model, a machine learning model, or a hybrid physics-based machine learning model for the first subterranean reservoir to provide first production data;

receiving, from a second robot associated with a second wellbore and by the processing device, second reservoir data associated with a second subterranean reservoir to be penetrated by the second wellbore, the second wellbore being associated with a second cluster of wellbores of the plurality of clustered wellbores;

simulating production using the second reservoir data associated with the second subterranean reservoir and using the physics-based model, the machine learning model, or the hybrid physics-based machine learning model for the second subterranean reservoir to provide second production data;

performing a Bayesian optimization of an objective function of the first and second production data subject to gas injection constraints and convergence criteria to produce gas-lift parameters, the Bayesian optimization being performed for each of the first cluster of wellbores, the second cluster of wellbores, and across the plurality of clustered wellbores; and applying the gas-lift parameters to a gas supply arrangement by performing a gas-lift control using the first robot or the second robot based on the gas-lift parameters in response to the convergence criteria being met to control an injection of gas into the first wellbore or the second wellbore.

16. The non-transitory computer-readable medium of claim 15, wherein the first wellbore and the second wellbore each include production tubing string, the operations further comprising:

injecting gas into the production tubing string downhole; and capturing gas at a gas storage device connected to the production tubing string.

17. The non-transitory computer-readable medium of claim 15, wherein the gas-lift parameters comprise gas injection rate and choke size, and wherein the gas injection rate is constant or a function of time.

18. The non-transitory computer-readable medium of claim 15, wherein the convergence criteria comprise a maximum number of iterations and a convergence within a specified tolerance to a maximum production rate and a minimum friction value for the production tubing.

19. The non-transitory computer-readable medium of claim 15, wherein the processing device comprises a robotic operating system, the non-transitory computer-readable medium comprising instructions that are executable by the processing device for causing the processing device to perform operations further comprising:

transmitting a signal to the first robot or the second robot associated with at least the first wellbore or the second wellbore to perform the gas-lift control based on the gas-lift parameters.

20. The non-transitory computer-readable medium of claim 19, the operations further comprising:

receiving, from the first robot having a first sensor, real-time production data associated with the first wellbore, the real-time production data associated with the first wellbore being the first reservoir data;

receiving, from the second robot having a second sensor, real-time production data associated with the second wellbore, the real-time production data associated with the first wellbore being the second reservoir data;

transmitting, using the first robot, the first reservoir data to the processing device; and transmitting, using the second robot, the second reservoir data to the processing device.

* * * * *